US009463504B2

(12) United States Patent
Joke et al.

(10) Patent No.: US 9,463,504 B2
(45) Date of Patent: Oct. 11, 2016

(54) CURING AGENT COMPOSITION FOR MAKING FOUNDRY MOLDS, USE OF THE SAME, METHOD OF PRODUCING THE SAME, AND METHOD OF MAKING FOUNDRY MOLD

(71) Applicant: KAO CORPORATION, Tokyo (JP)

(72) Inventors: Takashi Joke, Toyohashi (JP); Toshiki Matsuo, Toyohashi (JP)

(73) Assignee: KAO CORPORATION, Tokyo (JP)

( * ) Notice: Subject to any disclaimer, the term of this patent is extended or adjusted under 35 U.S.C. 154(b) by 61 days.

(21) Appl. No.: 14/397,416

(22) PCT Filed: Mar. 14, 2013

(86) PCT No.: PCT/JP2013/057252

§ 371 (c)(1),
(2) Date: Oct. 27, 2014

(87) PCT Pub. No.: WO2013/161426

PCT Pub. Date: Oct. 31, 2013

(65) Prior Publication Data

US 2015/0114588 A1 Apr. 30, 2015

(30) Foreign Application Priority Data

Apr. 27, 2012 (JP) ..... 2012-102948

(51) Int. Cl.
*B22C 1/22* (2006.01)
*B22C 1/00* (2006.01)
*B22C 9/02* (2006.01)

(52) U.S. Cl.
CPC ..... *B22C 1/224* (2013.01); *B22C 1/00* (2013.01); *B22C 1/2233* (2013.01); *B22C 1/2246* (2013.01); *B22C 1/2253* (2013.01); *B22C 9/02* (2013.01)

(58) Field of Classification Search
CPC ..... B22C 1/00; B22C 1/224; B22C 1/2246; B22C 1/2253; B22C 1/2333
See application file for complete search history.

(56) References Cited

U.S. PATENT DOCUMENTS 4,067,838 A 1/1978 Hayashi et al.
4,090,995 A 5/1978 Smillie
4,663,344 A * 5/1987 Durette ..... C07D 333/64 514/337
6,608,161 B1 * 8/2003 Corley ..... C08G 8/02 442/131
8,822,568 B2 * 9/2014 Kato ..... B22C 1/224 523/139
2011/0073269 A1 3/2011 Frohn et al.

FOREIGN PATENT DOCUMENTS

| | | | | |
|---|---|---|---|---|
| CN | 1631930 | A | 6/2005 | |
| CN | 103237614 | A | 8/2013 | |
| JP | 11-90580 | A | 4/1999 | |
| JP | 2000-225437 | A | 8/2000 | |
| JP | 2000-246391 | A | 9/2000 | |
| JP | 2005-175337 | A | 6/2005 | |
| JP | 2011-520615 | A | 7/2011 | |
| JP | 2011-245487 | A | 12/2011 | |
| JP | 2012-148340 | A | 8/2012 | |
| WO | WO 2011078082 | A1 * | 6/2011 | ..... B22C 1/224 |

OTHER PUBLICATIONS

International Preliminary Report on Patentability, and Translation of Written Opinion of the International Searching Authority, dated Nov. 6, 2014, for International Application No. PCT/JP2013/057252 (Forms PCT/IB/338, PCT/IB/373 and PCT/ISA/237).
International Search Report for PCT/JP2013/057252 mailed on Jun. 18, 2013.
Extended European Search Report, dated Dec. 14, 2015, for European Application No. 13781352.3.

* cited by examiner

*Primary Examiner* — Vickey Nerangis
(74) *Attorney, Agent, or Firm* — Birch, Stewart, Kolasch & Birch, LLP

(57) ABSTRACT

A curing agent composition for making foundry molds, comprising 2,6-dihydroxybenzoic acid. In a sand composition for making foundry molds, it is preferable to use simultaneously: an acid-hardening resin which contains both a binder composition for making foundry molds which comprises one or more 5-position-substituted furfural compounds selected from the group consisting of 5-hydroxymethylfurfural and 5-acetoxymethylfurfural, and the curing agent composition for making foundry molds which comprises 2,6-dihydroxybenzoic acid. It is preferable that the content of 2,6-dihydroxybenzoic acid in the curing agent composition is 10 to 80 wt %.

14 Claims, No Drawings

CURING AGENT COMPOSITION FOR MAKING FOUNDRY MOLDS, USE OF THE SAME, METHOD OF PRODUCING THE SAME, AND METHOD OF MAKING FOUNDRY MOLD

TECHNICAL FIELD

The present invention relates to a curing agent composition for making foundry molds; a sand composition for making foundry molds, using this curing agent composition; and a method of making a foundry mold.

BACKGROUND ART

Acid-hardening self-hardening molds are generally each produced by: adding, to refractory particles such as silica sand, a binder for making foundry molds containing an acid-hardening resin, and a hardener including a sulfonic acid, sulfuric acid, phosphoric acid, or some other acid; mixing these components; filling the resultant mixed sand composition into an original pattern such as a wooden pattern; and then hardening the acid-hardening resin. As the acid-hardening resin, for example, a furan resin, a phenolic resin or the like is used. As the furan resin, for example, the following is used: furfuryl alcohol, furfuryl alcohol/urea-formaldehyde resin, furfuryl alcohol/formaldehyde resin, furfuryl alcohol/phenol/formaldehyde resin, or some other known modified furan resin. The resultant mold is used at the time of casting for a mechanical component casting, a construction machine component, an automobile component, or some other casting.

An item important for making the above-mentioned foundry mold or using the foundry mold to cast into a desired casting is to make an odor less bad at the time of the casting. The odor at the casting time is mainly sulfur dioxide gas originating from the curing agent component. In order to improve the working environment in casting factories, it is necessary to decrease the amount of generated sulfur dioxide gas as much as possible.

As a method for solving this problem, conceivable is a method of decreasing the content by percentage of sulfonic acid in the curing agent composition. However, it is inevitable that the foundry mold hardening speed is not lowered by the decrease.

Thus, curing agent compositions are disclosed which are each a mixture of sulfonic acid and another acid that does not contain sulfur to decrease the content by percentage of sulfonic acid without lowering the mold hardening speed (Patent Documents 1 and 2).

Moreover, a binder composition containing calcium hydroxide is disclosed for restraining the generation of sulfur dioxide gas (Patent Document 3).

PRIOR ART DOCUMENTS

Patent Documents

Patent Document 1: JP-A-2011-520615
Patent Document 2: JP-A-11-90580
Patent Document 2: JP-A-2011-245487

SUMMARY OF THE INVENTION

The present invention relates to a curing agent composition for making foundry molds that contains 2,6-dihydroxybenzoic acid; a sand composition for making foundry molds, using this curing agent composition; and a method of making a foundry mold.

DETAILED DESCRIPTION OF THE INVENTION

Although the curing agent compositions in Patent Documents 1 and 2, and the binder composition in Patent Document 3 make the amount of generated sulfur dioxide gas small at the time of casting into a product, such compositions are desired to be further improved.

The present invention provides a curing agent composition, for making foundry molds, about which the hardening speed and the foundry mold strength can be improved while the resultant foundry mold makes it possible to decrease the amount of generated sulfur dioxide gas very much at the time of casting into a product; and a sand composition for making foundry molds, using this curing agent composition.

The curing agent composition of the present invention for making foundry molds is a curing agent composition for making foundry molds comprising 2,6-dihydroxybenzoic acid.

The sand composition of the present invention for making foundry molds is a sand composition for making foundry molds comprising a refractory particulate material, a binder composition for making foundry molds that comprises an acid-hardening resin, and a curing agent composition for making foundry molds that comprises 2,6-dihydroxybenzoic acid.

The method of making a foundry mold, which is a method of the present invention, comprises a mixing step of mixing a refractory particulate material, a binder composition for making foundry molds that comprises an acid-hardening resin, and a curing agent composition for making foundry molds that comprises 2,6-dihydroxybenzoic acid with each other to yield a sand composition for making foundry molds; and a curing step of curing this sand composition for making foundry molds.

According to the curing agent composition for making foundry molds of the present invention, the hardening speed and the mold strength are improved while the resultant foundry mold makes it possible to decrease the amount of generated sulfur dioxide gas very much at the time of casting into a product. As a result, the working environment is improved, and further the resultant casting is also improved in quality without undergoing gas defects.

[Curing Agent Composition for Making Foundry Molds]

The curing agent composition for making foundry molds (hereinafter referred to also as the "curing agent composition") is a composition used as a curing agent at the casting time, and is a composition containing 2,6-dihydroxybenzoic acid. The curing agent composition of the present invention contains neither sulfonic acid nor sulfuric acid. Even if the composition contains the acid, the amount thereof is very slight. This curing agent composition can express the foundry mold strength, and the resultant foundry mold makes it possible to decrease the amount of generated sulfur dioxide gas at the casting time. The reason why these advantageous effects are produced is unclear, but would be as follows:

2,6-Dihydroxybenzoic acid is low in pKa so as to be high in catalyst-function as an acid, and further has two points reactive with an acid-hardening resin. For this reason, this acid acts as an acid catalyst in the same manner as ordinary curing agents, and further reacts with the acid-hardening resin to contribute to the expression of the foundry mold strength. Thus, it is presumed that without using any strong acid such as sulfonic acid or sulfuric acid, the foundry mold can be hardened.

Hereinafter, a description will be made about the components contained in the curing agent composition of the present invention.

The curing agent composition of the present invention is a composition containing 2,6-dihydroxybenzoic acid to harden a binder composition for making foundry molds. In order to improve the hardening speed and the mold strength, the content by percentage of 2,6-dihydroxybenzoic acid in the curing agent composition is preferably from 10 to 80%, more preferably from 20 to 70%, even more preferably from 30 to 60% by weight The curing agent composition of the present invention is preferably a curing agent composition for an acid-hardening resin that is used for hardening the acid-hardening resin, which is a resin contained in a binder composition for making foundry molds, from the viewpoint of an improvement in the final mold strength and the hardening speed.

The curing agent composition of the present invention may contain, as its curing agent, a curing agent other than 2,6-dihydroxybenzoic acid. Examples of the curing agent include sulfonic acid type compounds such as xylenesulfonic acid (particularly, m-xylenesulfonic acid) and toluenesulfonic acid (particularly, p-toluenesulfonic acid); phosphoric acid type compounds; and sulfuric acid. However, in the case of using the curing agent composition containing a sulfur-containing acid such as sulfonic acid or sulfuric acid, sulfur dioxide gas is generated at the casting time. Thus, the content by percentage of the sulfur-containing acid in the curing agent composition is preferably 30% or less by weight, more preferably 10% or less by weight, even more preferably 5% or less by weight, even more preferably 1% or less by weight. It is preferred for the curing agent composition to contain, as its curing agent, only 2,6-dihydroxybenzoic acid without containing any sulfur-containing acid. In this case, the amount of generated sulfur dioxide gas can be controlled to zero at the casting time.

The curing agent composition of the present invention may contain one or more solvents selected from the group consisting of water, alcohols, ether alcohols, and esters in order to be added evenly to foundry sand and be blended evenly into a resin composition. Of these examples, preferred are alcohols and ether alcohols to improve the mold hardening speed and the mold strength. More preferred are alcohols having 1 to 3 carbon atoms. Specific examples of the alcohols include methanol, ethanol, propanol, and isopropanol. Methanol and ethanol are preferred, and methanol is more preferred. The curing agent composition of the present invention may contain water. When the solvent (s) is/are incorporated into the composition, the water content by percentage in the curing agent can be decreased so that the mold hardening speed is made better and further the mold strength is further improved. The solvent content by percentage in the curing agent composition is preferably from 20 to 90% by weight, more preferably from 30 to 80% by weight, even more preferably from 40 to 70% by weight from the viewpoint of an improvement in the mold strength and the performance of dissolving the curing agent composition. In order to decrease the viscosity of the curing agent, methanol and ethanol are preferred, and methanol is more preferred.

The curing agent composition may be added in the form of a solid, without containing such a solvent, to a foundry mold.

The curing agent composition of the present invention can be produced preferably by a method of dissolving 2,6-dihydroxybenzoic acid into an alcohol having 1 to 3 carbon atoms. At the time of dissolving 2,6-dihydroxybenzoic acid into the alcohol having 1 to 3 carbon atoms, the present system may be heated to 40 to 50° C. as required to dissolve the acid.

[Sand Composition for Making Foundry Molds]

The sand composition of the present invention for making foundry molds contains a refractory particulate material, a binder composition for making foundry molds that contains an acid-hardening resin, and a curing agent composition for making foundry molds that contains 2,6-dihydroxybenzoic acid.

<Binder Composition for Making Foundry Molds>

The binder composition for making foundry molds (hereinafter referred to also as the "binder composition") is a composition used as a binder when a foundry mold is made, and is a binder composition for making foundry molds containing an acid-hardening resin.

It is preferred that the binder composition further contains one or more 5-position-substituted furfural compounds selected from the group consisting of 5-hydroxymethylfurfural and 5-acetoxymethylfurfural to improve the hardening speed and the mold strength. From the viewpoint of the improvement in the mold strength, the content by percentage of the 5-position-substituted furfural compound(s) in the binder composition is preferably 5% or more by weight, more preferably 20% or more by weight. From the viewpoint of the improvement in the mold strength, the content by percentage of the 5-position-substituted furfural compound(s) in the binder composition is preferably 80% or less by weight, more preferably 60% or less by weight, even more preferably 40% or less by weight. When these matters are synthesized, the content by percentage of the 5-position-substituted furfural compound(s) in the binder composition is preferably from 5 to 80% by weight, more preferably from 5 to 60% by weight, even more preferably from 20 to 40% by weight to improve the mold strength. From the viewpoint of the improvement in the hardening speed, the content by percentage of the 5-position-substituted furfural compound(s) in the binder composition is preferably 20% or more by weight, more preferably 30% or more by weight. From the viewpoint of the improvement in the hardening speed, the content by percentage of the 5-position-substituted furfural compounds) in the binder composition is preferably 80% or less by weight, more preferably 60% or less by weight, even more preferably 50% or less by weight. When these matters are synthesized, the content by percentage of the 5-position-substituted furfural compound(s) in the binder composition is preferably from 20 to 80% by weight, more preferably from 20 to 60% by weight, even more preferably from 30 to 50% by weight to improve the hardening speed.

The binder composition preferably contains, Of these two furfural compounds, 5-hydroxymethylfurfural from the viewpoint of the improvement in the hardening speed and the mold strength. From the viewpoint of the improvement in the mold strength, the content by percentage of 5-hydroxymethylfurfural in the binder composition is preferably 5% or more by weight, more preferably 20% or more by weight. From the viewpoint of the improvement in the mold strength, the content by percentage of 5-hydroxymethylfurfural in the binder composition is preferably 80% or less by weight, more preferably 60% or less by weight, even more preferably 40% or less by weight. When these matters are synthesized, the content by percentage of 5-hydroxymethylfurfural in the binder composition is preferably from 5 to 80% by weight, more preferably from 5 to 60% by weight, even more preferably from 20 to 40% by weight to improve the mold strength. From the viewpoint of the improvement in the hardening speed, the content by percentage of 5-hydroxymethylfurfural in the binder composition is preferably 20% or more by weight, more preferably 30% or more by weight. From the viewpoint of the improvement in the hardening speed, the content by percentage of 5-hydroxymethylfurfural in the binder composition is preferably 80% or less by weight, more preferably 60% or less, even more preferably 50% or less by weight. When these matters are synthesized, the content by percentage of 5-hydroxymethylfurfural in the binder composition is preferably from 20 to 80% by weight, more preferably from 20 to 60% by weight, even more preferably from 30 to 50% by weight to improve the hardening speed.

The acid-hardening resin contained in the binder composition may be a resin known in the prior art, and may be one selected from the group consisting of furfuryl alcohol, furfuryl alcohol condensed products, phenolic resins, urea-modified furan resins, condensed products each made from melamine and an aldehyde, and condensed products each made from urea and an aldehyde; or a mixture of two or more selected from the group. The acid-hardening resin may also be a co-condensed product of two or more selected from the group. From the viewpoint of the improvement in the mold strength and the hardening speed, the acid-hardening resin is preferably furfuryl alcohol, or any furfuryl alcohol condensed product, phenolic acid, or urea-modified furan resin.

From the viewpoint of an improvement of the resultant casting in quality, and an improvement in the hardening speed, the nitrogen content by percentage in the binder composition is preferably from 0.5 to 4% by weight. In order to adjust the nitrogen content by percentage in the binder composition in the range, it is advisable to adjust the content by percentage of any nitrogen-containing compound in the binder composition. Examples of the nitrogen-containing compound include urea-modified furan resins, and urea/aldehyde condensed products.

The binder composition of the present invention may contain a hardening promoter from the viewpoint of improving the hardening speed and the mold strength. The hardening promoter may be a hardening promoter contained in the binder composition. Another hardening promoter may be added to the composition for a mold. The hardening promoter is preferably one or more selected from the group consisting of a compound represented by the following general formula (1) (which is referred to as hardening promoter (1) hereinafter), a polyhydric phenol, and an aromatic dialdehyde from the viewpoint of improving the hardening speed and the mold strength:

[Formula 1]

(1)

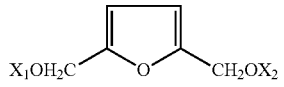

wherein $X_1$ and $X_2$ each represent any of a hydrogen atom, $CH_3$ or $C_2H_5$.

Examples of the hardening promoter (1) include 2,5-bis(hydroxymethyl)furan, 2,5-bis(methoxymethyl)furan, 2,5-bis(ethoxymethyl)furan, 2-hydroxymethyl-5-methoxymethylfuran, 2-hydroxymethyl-5-ethoxymethylfuran, and 2-methoxymethyl-5-ethoxymethylfuran.

Examples of the polyhydric phenolic compound include resorcin, cresol, hydroquinone, phloroglucinol, methylenebisphenol, condensed tannins, hydrolyzable tannins and the like.

Examples of the aromatic dialdehyde include terephthalaldehyde, phthalaldehyde, isophthalaldehyde and the like; and derivatives thereof, and the like.

The binder composition may further contain water. For example, in the case of synthesizing various condensed products such as a condensed product made from furfuryl alcohol and an aldehyde, a raw material in the form of an aqueous solution is used, or condensation water is generated so that the condensed product is usually yielded in the form of a mixture of the product and water. When such a condensed product is used in the binder composition, it is unnecessary that the water originating from the process of the synthesis dares to be removed. Water may be further added thereto for the purpose of making the binder composition into an easily-handleable viscosity, or for some other purpose. However, if the water content becomes excessive, it is feared that the hardening reaction of the acid-hardening resin is hindered. Thus, the water content in the binder composition is preferably set into the range of 0 to 30% by weight. The content thereof is more preferably from 0.5 to 5% by weight, even preferably from 0.7 to 3.5% by weight from the viewpoint of making the binder composition easily-handleable and from the viewpoint of keeping the hardening reaction rate.

The binder composition may further contain therein additives such as a silane coupling agent and the like. When the composition contains, for example, a silane coupling agent, the strength of the resultant mold can be favorably improved. Usable examples of the silane coupling agent include aminosilanes such as N-β-(aminoethyl)-γ-aminopropylmethyldimethoxysilane, N-β-(aminoethyl)-γ-aminopropyltrimethoxysilane, N-β-(aminoethyl)-γ-aminopropyltriethoxysilane, 3-aminopropyltrimethoxysilane and the like; epoxysilanes such as 3-glycidoxypropyltrimethoxysilane, 3-glycidoxypropyltriethoxysilane, 3-glycidoxypropylmethyldiethoxysilane, 3-glycidoxypropyltriethoxysilane and the like, ureidosilanes, mercaptosilanes, sulfidesilanes, methacryloxysilanes, acryloxysilanes and the like. Preferred are aminosilanes, epoxysilanes and ureidosilanes. More preferred are aminosilanes and epoxysilanes. Even preferred are aminosilanes. Of the aminosilanes, preferred is N-β-(aminoethyl)-γ-aminopropylmethyldimethoxysilane. The content of the silane coupling agent in the binder composition is preferably from 0.01 to 0.5% by weight, more preferably from 0.05 to 0.3% by weight from the viewpoint of the mold strength.

The binder composition can be produced by mixing a silane coupling agent and/or 5-hydroxymethylfurfural with the acid-hardening resin, and adjusting the concentration in the mixture finally with furfuryl alcohol.

<Refractory Particles>

The refractory particles may be conventionally known particles such as silica sand, chromite sand, zircon sand, olivine sand, alumina sand, mullite sand, synthetic mullite sand and the like. The particles may be particles obtained by collecting used refractory particles, or subjecting the used particles to reclaiming treatment, or other particles.

The sand composition for making foundry molds of the present invention preferably contains the binder composition for making foundry molds in an amount of 0.5 to 3.0 parts by mass for 100 parts by weight of the refractory particle, and the curing agent composition for making foundry molds in an amount of 0.07 to 2.0 parts by weight for the same from the viewpoint of an improvement in the mold strength.

When 2,6-dihydroxybenzoic acid is present together with one or more 5-position-substituted furfural compounds selected from the group consisting of 5-hydroxymethylfurfural and 5-acetoxymethylfurfural, preferably 5-hydroxymethylfurfural, the content of 2,6-dihydroxybenzoic acid in the sand composition for making foundry molds is preferably 0.1 parts or more by weight, more preferably 0.14 parts or more by weight, even more preferably 0.2 parts or more by weight for 1.0 part by weight of the binder composition, and is preferably 0.8 parts or less by weight, more preferably 0.6 parts or less by weight, even more preferably 0.4 parts or less by weight for the same from the viewpoint of an improvement in the mold strength. These matters are synthesized as follows: when 2,6-dihydroxybenzoic acid is present together with the 5-position-substituted furfural compound(s), preferably 5-hydroxymethylfurfural, the content of 2,6-dihydroxybenzoic acid in the sand composition for making foundry molds is preferably from 0.1 to 0.8 parts by weight, more preferably from 0.14 to 0.6 parts by weight, even more preferably from 0.2 to 0.4 parts by weight for 1.0 part by weight of the binder composition from the viewpoint of an improvement in the mold strength. When no 5-position-substituted furfural compound is present in the sand composition for making foundry molds, the content of 2,6-dihydroxybenzoic acid in the sand composition is preferably 0.2 parts or more by weight, more preferably 0.3 parts or more by weight for 1.0 part by weight of the binder composition, and is preferably 0.8 parts or less by weight, more preferably 0.4 parts or less by weight for the same from the viewpoint of an improvement in the mold strength. These matters are synthesized as follows: the content of 2,6-dihydroxybenzoic acid in the sand composition for making foundry molds is preferably from 0.2 to 0.8 parts by weight, more preferably from 0.3 to 0.4 parts by weight for 1.0 part by weight of the binder composition from the viewpoint of an improvement in the mold strength.

[Method of Making a Sand Composition for Making Foundry Molds]

The sand composition for making foundry molds of the present invention is produced through a mixing step of mixing a refractory particulate material, a binder composition for making foundry molds that includes an acid-hardening resin, and a curing agent composition for making foundry molds that includes 2,6-dihydroxybenzoic acid with each other.

Preferably, the sand composition for making foundry molds of the present invention is produced through a first mixing step of mixing the refractory particulate material with the curing agent composition for making foundry molds, which includes 2,6-dihydroxybenzoic acid, and a second mixing step of mixing the binder composition for making foundry molds with the mixture yielded after the first mixing step.

[Method of Making Foundry Mold]

A foundry mold according to the present invention is made through a hardening step of hardening the sand composition for making foundry molds yielded through the afore-mentioned mixing step. In the method of making a foundry mold, which is a method of the present invention, the foundry mold can be made, using a conventional foundry-mold-making process as it is.

Preferably, a foundry mold according to the present invention can be made by hardening the sand composition for making foundry molds produced through the mixing step including the first mixing step of mixing the refractory particulate material with the curing agent composition for making foundry molds, which includes the compound 2,6-dihydroxybenzoic acid, and the second mixing step of mixing the binder composition for making foundry molds with the mixture yielded after the first mixing step.

The composition of the present invention is:

<1> A curing agent composition for making foundry molds, comprising 2,6-dihydroxybenzoic acid.

The present invention preferably includes the following compositions, producing methods, and uses:

<2> The curing agent composition for making foundry molds according to item <1>, wherein the content by percentage of the compound 2,6-dihydroxybenzoic acid is preferably from 10 to 80% by weight, more preferably from 20 to 70% by weight, even more preferably from 30 to 60% by weight.

<3> The curing agent composition for making foundry molds according to item <1> or <2>, which is an acid-hardening-resin curing agent composition for curing an acid-hardening resin contained in a binder composition for making foundry molds.

<4> A sand composition for making foundry molds, comprising a refractory particulate material, a binder composition for making foundry molds that comprises an acid-hardening resin, and the curing agent composition for making foundry molds recited in any one of items <1> to <3>.

<5> The sand composition for making foundry molds according to item <4>, wherein the binder composition for making foundry molds is contained preferably in an amount of 0.5 to 3.0 parts by weight for 100 parts by weight of the refractory particulate material, and the curing agent composition for making foundry molds is contained preferably in an amount of 0.07 to 2.0 parts by weight for the same.

<6> The sand composition for making foundry molds according to item <4> or <5>, wherein when the compound 2,6-dihydroxybenzoic acid is present together with one or more 5-position-substituted furfural compounds selected from the group consisting of 5-hydroxymethylfurfural and 5-acetoxymethylfurfural, preferably 5-hydroxymethylfurfural, the content of the compound 2,6-dihydroxybenzoic acid in this sand composition is preferably from 0.1 to 0.8 parts, more preferably from 0.14 to 0.6 parts by weight, even more preferably from 0.2 to 0.4 parts by weight for 1.0 part by weight of the binder composition for making foundry molds, or when the binder composition for making foundry molds comprises no 5-position-substituted furfural compound, the content of the compound 2,6-dihydroxybenzoic acid is preferably from 0.2 to 0.8 parts by weight, more preferably from 0.3 to 0.4 parts by weight for the same.

<7> The sand composition for making foundry molds according to any one of items <4> to <6>, wherein the binder composition for making foundry molds further comprises one or more 5-position-substituted furfural compounds selected from the group consisting of 5-hydroxymethylfurfural and 5-acetoxymethylfurfural, preferably 5-hydroxymethylfurfural.

<8> The sand composition for making foundry molds according to item <7>, wherein the content by percentage of the 5-position-substituted furfural compound(s) selected from the group consisting of 5-hydroxymethylfurfural and 5-acetoxymethylfurfural, preferably 5-hydroxymethylfurfural, in the binder composition is preferably from 5 to 80% by weight, more preferably from 5 to 60% by weight, even more preferably from 20 to 60% by weight, even more preferably from 20 to 40% by weight, even more preferably from 30 to 50% by weight.

<9> The sand composition for making foundry molds according to any one of items <4> to <8>, wherein the acid-hardening resin is one or more selected from the group consisting of furfuryl alcohol, furfuryl alcohol condensed products, phenolic resins, and urea-modified furan resins.

<10> The sand composition for making foundry molds according to any one of items <4> to <9>, wherein the nitrogen content by percentage in the binder composition is preferably from 0.5 to 4% by weight.

<11> A method of making a foundry mold, comprising a mixing step of mixing a refractory particulate material, a binder composition for making foundry molds that comprises an acid-hardening resin, and a curing agent composition for making foundry molds that comprises 2,6-dihydroxybenzoic acid with each other to yield a sand composition for making foundry molds; and a hardening step of hardening the sand composition for making foundry molds.

<12> The method of making a foundry mold according to item <11>, wherein the content by percentage of the compound 2,6-dihydroxybenzoic acid in the curing agent composition is preferably from 10 to 80% by weight, more preferably from 20 to 70% by weight, even more preferably from 30 to 60% by weight.

<13> The method of making a foundry mold according to item <11> or <12>, wherein the binder composition for making foundry molds is added preferably in an amount of 0.5 to 3.0 parts by weight for 100 parts by weight of the refractory particulate material, and the curing agent composition for making foundry molds is added preferably in an amount of 0.07 to 2.0 parts by weight for the same.

<14> The method of making a foundry mold according to any one of items <11> to <13>, wherein when the compound 2,6-dihydroxybenzoic acid is present together with one or more 5-position-substituted furfural compounds selected from the group consisting of 5-hydroxymethylfurfural and 5-acetoxymethylfurfural, preferably 5-hydroxymethylfurfural, the content of the compound 2,6-dihydroxybenzoic acid is preferably from 0.1 to 0.8 parts by weight, more preferably from 0.14 to 0.6 parts by weight, even more preferably from 0.2 to 0.4 parts by weight for 1.0 part by weight of the binder composition for making foundry molds, or when the binder composition for making foundry molds comprises no 5-position-substituted furfural compound, the content of the compound 2,6-dihydroxybenzoic acid is preferably from 0.2 to 0.8 parts by weight, more preferably from 0.3 to 0.4 parts by weight for the same.

<15> The method of making a foundry mold according to any one of items <11> to <14>, wherein the binder composition for making foundry molds further comprises one or more 5-position-substituted furfural compounds selected from the group consisting of 5-hydroxymethylfurfural and 5-acetoxymethylfurfural, preferably 5-hydroxymethylfurfural.

<16> The method of making a foundry mold according to item <15>, wherein the content by percentage in the 5-position-substituted furfural compound(s) selected from the group consisting of 5-hydroxymethylfurfural and 5-acetoxymethylfurfural, preferably 5-hydroxymethylfurfural, in the binder composition is preferably from 5 to 80% by weight, more preferably from 5 to 60% by weight, even more preferably from 20 to 60% by weight, even more preferably from 20 to 40% by weight, even more preferably from 30 to 50% by weight.

<17> The method of making a foundry mold according to any one of items <11> to <16>, wherein the mixing step comprises a first mixing step of mixing the refractory particulate material with the curing agent composition for making foundry molds, which comprises the compound 2,6-dihydroxybenzoic acid, and a second mixing step of mixing the binder composition for making foundry molds with the mixture yielded after the first mixing step.

<18> Use of a composition comprising 2,6-dihydroxybenzoic acid as a curing agent for making foundry molds.

<19> Use of a composition as a sand for making foundry molds, the composition being a composition comprising: a refractory particulate material; a binder composition for making foundry molds that comprises an acid-hardening resin, preferably a binder composition for making foundry molds that comprises the same resin and one or more 5-position-substituted furfural compounds selected from the group consisting of 5-hydroxymethylfurfural and 5-acetoxymethylfurfural, preferably 5-hydroxymethylfurfural; and a curing agent composition for making foundry molds that comprises 2,6-dihydroxymethylfurfural.

<20> A method of producing a curing agent composition for making foundry molds, comprising a dissolving step of dissolving the compound 2,6-dihydroxybenzoic acid into an alcohol having 1 to 3 carbon atoms, and optionally comprising a heating and dissolving step of heating the resultant at 40 to 50° C. to be dissolved.

<21> A method of producing a sand composition for making foundry molds, comprising a mixing step of mixing a refractory particulate material, a binder composition for making foundry molds that comprises an acid-hardening resin, and a curing agent composition for making foundry molds that comprises 2,6-dihydroxybenzoic acid with each other.

<22> The method of producing a sand composition for making foundry molds according to item <21>, comprising a first mixing step of mixing the refractory particulate material with the curing agent composition for making foundry molds, which comprises the compound 2,6-dihydroxybenzoic acid, and a second mixing step of mixing the binder composition for making foundry molds with the mixture yielded after the first mixing step.

Hereinafter, a description will be made about working examples demonstrating the present invention specifically, and others. About evaluating items in the working examples and the others, the following measurements were made:

<Furfuryl Alcohol Content in Binder Composition>

The content was measured by gas chromatography. Furfuryl alcohol was used to prepare a calibration curve. Measuring conditions:

Internal standard solution: 1,6-hexanediol

Column: PEG-20M Chromosorb WAW DMCS 60/80 mesh (manufactured by GL Sciences Inc.)

Column temperature: 80 to 200° C. (8° C./min)

Injection temperature: 210° C.

Detector temperature: 250° C.

Carrier gas: 50 mL/min (He)

<Nitrogen Content in Binder Composition>

The nitrogen content was measured by Kjeldahl method described in JIS M 8813.

Regarding each of Examples 1, 5, 6, 16, 19, and 20, the percentage by weight of nitrogen in the binder composition was 0.00% by weight; regarding Examples 17, the percentage was 0.9% by weight; regarding each of Examples 2 to 4, 7 to 15, 21, and 22, and Comparative Examples 1 to 16, the percentage was 1.8% by weight; regarding Example 18, the percentage was 3.0% by weight.

<Production of Condensed Product 1>

In a three-necked flask, the following were mixed with each other: 100 parts by weight of furfuryl alcohol; 35 parts by weight of paraformaldehyde; and 13 parts by weight of urea. The mixture was adjusted into a pH of 9 with a 25% solution of sodium hydroxide in water, and heated to 100° C. At the same temperature, reactive components therein were then caused to react with each other for 1 hour, and then the resultant was adjusted into a pH of 4.5 with 37% hydrochloric acid. Reactive components therein were further caused to react with each other at 100° C. for 1 hour. Thereafter, the resultant was adjusted into a pH of 7 with a 25% solution of sodium hydroxide in water, and to this system were added 5 parts by weight of urea. Reactive components therein were then caused to react with each other at 100° C. for 30 minutes to yield a reaction product 1. An unreacted fraction of furfuryl alcohol was analyzed by the above-mentioned analyzing method, and a fraction obtained by removing the unreacted fraction of furfuryl alcohol from the whole was called a condensed product 1. The composition of the condensed product 1 was composed of 89% by weight of urea-modified furan resin and 11% by weight of water.

<Production of Condensed Product 2>

In a three-necked flask, the following were mixed with each other: 100 parts by weight of phenol; and 45 parts by weight of paraformaldehyde. The mixture was adjusted into a pH of 8.0 with a 48% solution (manufactured by Toa Gosei Co., Ltd.) of potassium hydroxide in water, and reactive components therein were caused to react with each other at 80° C. for 10 hours to yield a condensed product 2. The composition thereof was composed of 90% by weight of phenolic resin and 10% by weight of water.

<Production of Condensed Product 3>

In a three-necked flask, 100 parts by weight of furfuryl alcohol were adjusted into a pH of 4 with 85% phosphoric acid, and then caused to undergo reaction at 100° C. for 60 minutes to yield a condensed product 3. An unreacted fraction of furfuryl alcohol was analyzed by the above-mentioned analyzing method, and a fraction obtained by removing the unreacted fraction of furfuryl alcohol from the whole was called a condensed product 3. The composition thereof was composed of 96% by weight of a furfuryl alcohol condensed product and 4% by weight of water.

Examples 1 to 22, and Comparative Examples 1 to 16

Production of Curing Agent Compositions

A curing agent composition of each of Examples 1 to 22 and Comparative Examples 1 to 16 was produced by mixing one out of hardening agents shown in Tables 1, 2 and 3 (2,6-dihydroxybenzoic acid, 3,5-dihydroxybenzoic acid, 2,4-dihydroxybenzoic acid, 2,5-dihydroxybenzoic acid, 2,3-dihydroxybenzoic acid, 3,4-dihydroxybenzoic acid, p-hydroxybenzoic acid, oxalic acid, and citric acid), and methanol at a predetermined ratio, and optionally heating the mixture to a temperature of 40 to 50° C. to be melted.

<Production of Binder Compositions>

A binder composition of each of Examples 1 to 22, and Comparative Examples 1 to 16 was produced by mixing one of the resins shown in Tables 1, 2 and 3 (the condensed products 1, 2 and 3), FFA, HMF, AMF, and a silane coupling agent with each other at a predetermined ratio. The abbreviation "FFA" represents furfuryl alcohol; "HMF", 5-hydroxymethylfurfural and; "AMF", 5-acetoxymethylfurfural. The wording "silane coupling agent" denotes N-β-(aminoethyl)-γ-aminopropylmethyldimethoxysilane.

<Production of Sand Composition for Making Foundry Molds>

In the case of the presence of 2,6-dihydroxybenzoic acid without using HMF, a sand composition for making foundry molds was yielded by adding 1.4 parts by weight of each of the curing agent compositions shown in Table 1 to 100 parts by weight of silica new sand (Fremantle) at 25° C. and 55% RH, next adding thereto 2.0 parts by weight of the corresponding binder composition shown in Table 1, and then mixing these compositions with each other. In the case of the presence of 2,6-dihydroxybenzoic acid together with HMF, a sand composition for making foundry molds was yielded by adding 0.7 parts by weight of each of the curing agent compositions shown in Table 2 to 100 parts by weight of silica new sand (Fremantle) at 25° C. and 55% RH, next adding thereto 1.0 part by weight of the corresponding binder composition shown in Table 2, and then mixing these compositions with each other. In the case of the presence of 2,6-dihydroxybenzoic acid without using HMF, a sand composition for making foundry molds was yielded by adding 0.7 parts by weight of each of the curing agent compositions shown in Table 3 to 100 parts by weight of silica new sand (Fremantle) at 25° C. and 55% RH, next adding thereto 1.0 part by weight of the corresponding binder composition shown in Table 3, and then mixing these compositions with each other.

Test Example 1

Each of the sand compositions for making foundry molds just after the mixing was filled into test piece frames in the form of a column having a diameter of 50 mm and a height of 50 mm, and then the sand composition was stripped therefrom when 1 hour and 2 hours elapsed, respectively. By a method described in JIS Z 2604-1976, the respective compression strengths (MPa) of the resultant samples were measured, and defined as the "compression strength after one hour" and the "compression strength after two hours". As these values are higher, the sand compositions are better in hardening speed. The results are shown in Tables 1, 2, and 3.

Test Example 2

The individual sand compositions produced separately in the same ways, which were each filled into a test piece frame, were each stripped from the frame when 3 hours elapsed. After 24 hours from the filling, the compression strength (MPa) thereof was measured in the method described in JIS Z 2604-1976. The resultant value was defined as the "compression strength after 24 hours". As the value is higher, the sand compositions give a better mold strength. The results are shown in Tables 1, 2, and 3.

TABLE 1

| | Binder composition | | | | Curing agent composition | | | | | |
|---|---|---|---|---|---|---|---|---|---|---|
| | Resin | | FFA | Silane coupling agent | Curing agent | | Solvent | | Addition amount [part by weight] of curing agent for 1.0 part by weight of binder composition | Mold strength |
| | Species | Addition proportion [% by weight] | Addition proportion [% by weight] | Addition proportion [% by weight] | Species | Addition proportion [% by weight] | Species | Addition proportion [% by weight] | | Compression strength [MPa] after 24 hours |
| Example 1 | — | 0 | 99.85 | 0.15 | 2,6-DHB | 55.00 | Methanol | 45.00 | 0.39 | 4.37 |
| Example 2 | Condensed product 1 | 16.11 | 83.74 | 0.15 | 2,6-DHB | 43.00 | Methanol | 57.00 | 0.3 | 3.14 |

TABLE 1-continued

| | Binder composition | | | | Curing agent composition | | | | | |
|---|---|---|---|---|---|---|---|---|---|---|
| | Resin | | FFA | Silane coupling agent | Curing agent | | Solvent | | Addition amount [part by weight] of curing agent | Mold strength |
| | Species | Addition proportion [% by weight] | Addition proportion [% by weight] | Addition proportion [% by weight] | Species | Addition proportion [% by weight] | Species | Addition proportion [% by weight] | for 1.0 part by weight of binder composition | Compression strength [MPa] after 24 hours |
| Example 3 | Condensed product 1 | 16.11 | 83.74 | 0.15 | 2,6-DHB | 50.00 | Methanol | 50.00 | 0.35 | 3.72 |
| Example 4 | Condensed product 1 | 16.11 | 83.74 | 0.15 | 2,6-DHB | 55.00 | Methanol | 45.00 | 0.39 | 4.55 |
| Example 5 | Condensed product 2 | 16.00 | 83.85 | 0.15 | 2,6-DHB | 55.00 | Methanol | 45.00 | 0.39 | 4.18 |
| Example 6 | Condensed product 3 | 17.60 | 82.25 | 0.15 | 2,6-DHB | 55.00 | Methanol | 45.00 | 0.39 | 4.45 |
| Comparative Example 1 | Condensed product 1 | 16.11 | 83.74 | 0.15 | Oxalic acid | 50.00 | Methanol | 50.00 | 0.35 | 2.31 |
| Comparative Example 2 | Condensed product 1 | 16.11 | 83.74 | 0.15 | 3,5-DHB | 50.00 | Methanol | 50.00 | 0.35 | 0 |
| Comparative Example 3 | Condensed product 1 | 16.11 | 83.74 | 0.15 | 2,4-DHB | 50.00 | Methanol | 50.00 | 0.35 | 0 |
| Comparative Example 4 | Condensed product 1 | 16.11 | 83.74 | 0.15 | 2,5-DHB | 50.00 | Methanol | 50.00 | 0.35 | 0 |
| Comparative Example 5 | Condensed product 1 | 16.11 | 83.74 | 0.15 | 2,3-DHB | 50.00 | Methanol | 50.00 | 0.35 | 0 |
| Comparative Example 6 | Condensed product 1 | 16.11 | 83.74 | 0.15 | 3,4-DHB | 50.00 | Methanol | 50.00 | 0.35 | 0 |
| Comparative Example 7 | Condensed product 1 | 16.11 | 83.74 | 0.15 | p-HB | 50.00 | Methanol | 50.00 | 0.35 | 0 |
| Comparative Example 8 | Condensed product 1 | 16.11 | 83.74 | 0.15 | Citric acid | 50.00 | Methanol | 50.00 | 0.35 | 0 |

* About any one of the curing agent compositions, components insoluble at room temperature were heated to be dissolved.
* Condensed product 1: 89% by weight of urea-modified furan resin, and 11% by weight of water
* Condensed product 2: 90% by weight of phenolic resin (ratio by mole of formaldehyde to phenol: 1/1.3) and 10% by weight of water
* Condensed product 3: 96% by weight of furfuryl alcohol condensed product and 4% by weight of water
* FFA: furfuryl alcohol
* Silane coupling agent: N-β-(aminoethyl)-γ-aminopropylmethyldimethoxysilane
* DHB: dihydroxybenzoic acid; and HB: hydroxybenzoic acid It is understood from the results in Table 1 that in Examples 1 to 6, the hardening speed and the mold strength are improved. Moreover, in Examples 1 to 6, the amount of sulfur dioxide gas generated at the time of casting into a product is controlled into zero since a sulfur-containing acid such as sulfonic acid or sulfuric acid is not used. By contrast, it is understood that in each of Comparative Examples 1 to 8, mold strength is not expressed even after 24 hours and the hardening speed and the mold strength are each deteriorated since the curing agent other than 2,6-dihydroxybenzoic acid is used.

TABLE 2

| | Binder composition | | | | | | Curing agent composition | | | | | | | |
|---|---|---|---|---|---|---|---|---|---|---|---|---|---|---|
| | Resin | | FFA | Additive | | Silane coupling agent | Curing agent | | Solvent | | Addition amount [part by weight] of curing agent for 1.0 part by weight of binder composition | Hardening speed | | Mold strength |
| | Species | Addition proportion [% by weight] | Addition proportion [% by weight] | Species | Addition proportion [% by weight] | Addition proportion [% by weight] | Species | Addition proportion [% by weight] | Species | Addition proportion [% by weight] | | Compression strength [MPa] after one hours | Compression strength [MPa] after two hours | Compression strength [MPa] after 24 hours |
| Example 7 | Condensed product 1 | 16.11 | 53.74 | HMF | 30.00 | 0.15 | 2,6-DHB | 14.00 | Methanol | 86.00 | 0.10 | 0 | 0 | 3.13 |
| Example 8 | Condensed product 1 | 16.11 | 53.74 | HMF | 30.00 | 0.15 | 2,6-DHB | 20.00 | Methanol | 80.00 | 0.14 | 0 | 0 | 4.45 |
| Example 9 | Condensed product 1 | 16.11 | 53.74 | HMF | 30.00 | 0.15 | 2,6-DHB | 30.00 | Methanol | 70.00 | 0.21 | 0 | 0.58 | 5.19 |
| Example 10 | Condensed product 1 | 16.11 | 53.74 | HMF | 30.00 | 0.15 | 2,6-DHB | 45.00 | Methanol | 55.00 | 0.32 | 0.62 | 2.69 | 4.95 |
| Example 11 | Condensed product 1 | 16.11 | 53.74 | HMF | 30.00 | 0.15 | 2,6-DHB | 55.00 | Methanol | 45.00 | 0.39 | 1.24 | 2.49 | 4.22 |
| Example 12 | Condensed product 1 | 16.11 | 53.74 | AMF | 30.00 | 0.15 | 2,6-DHB | 55.00 | Methanol | 45.00 | 0.39 | 0.00 | 0.58 | 5.61 |
| Example 13 | Condensed product 1 | 16.11 | 73.74 | HMF | 10.00 | 0.15 | 2,6-DHB | 55.00 | Methanol | 45.00 | 0.39 | 0 | 0 | 3.28 |
| Example 14 | Condensed product 1 | 16.11 | 33.74 | HMF | 50.00 | 0.15 | 2,6-DHB | 55.00 | Methanol | 45.00 | 0.39 | 2.21 | 2.42 | 3.32 |
| Example 15 | Condensed product 1 | 16.11 | 13.74 | HMF | 70.00 | 0.15 | 2,6-DHB | 55.00 | Methanol | 45.00 | 0.39 | 1.73 | — | 3.10 |
| Example 16 | — | 0 | 69.85 | HMF | 30.00 | 0.15 | 2,6-DHB | 55.00 | Methanol | 45.00 | 0.39 | 0.21 | 2.65 | 4.74 |
| Example 17 | Condensed product 1 | 8.06 | 61.79 | HMF | 30.00 | 0.15 | 2,6-DHB | 55.00 | Methanol | 45.00 | 0.39 | 0.42 | 2.09 | 4.27 |
| Example 18 | Condensed product 1 | 26.85 | 43.00 | HMF | 30.00 | 0.15 | 2,6-DHB | 55.00 | Methanol | 45.00 | 0.39 | 1.30 | 2.36 | 3.31 |
| Example 19 | Condensed product 2 | 16.00 | 53.85 | HMF | 30.00 | 0.15 | 2,6-DHB | 55.00 | Methanol | 45.00 | 0.39 | 0 | 0.96 | 4.67 |
| Example 20 | Condensed product 3 | 17.60 | 52.25 | HMF | 30.00 | 0.15 | 2,6-DHB | 55.00 | Methanol | 45.00 | 0.39 | 0 | 0.84 | 5.28 |
| Comparative Example 9 | Condensed product 1 | 16.11 | 53.74 | HMF | 30.00 | 0.15 | 3,5-DHB | 30.00 | Methanol | 70.00 | 0.21 | 0 | 0 | 0 |
| Comparative Example 10 | Condensed product 1 | 16.11 | 53.74 | HMF | 30.00 | 0.15 | 2,4-DHB | 30.00 | Methanol | 70.00 | 0.21 | 0 | 0 | 0 |

TABLE 2-continued

| | Binder composition | | | | | | Curing agent composition | | | | | | | |
|---|---|---|---|---|---|---|---|---|---|---|---|---|---|---|
| | Resin | | FFA | Additive | | Silane coupling agent | Curing agent | | Solvent | | Addition amount [part by weight] of curing agent | Hardening speed | | Mold strength |
| | Species | Addition proportion [% by weight] | Addition proportion [% by weight] | Species | Addition proportion [% by weight] | Addition proportion [% by weight] | Species | Addition proportion [% by weight] | Species | Addition proportion [% by weight] | for 1.0 part by weight of binder composition | Compression strength [MPa] after one hours | Compression strength [MPa] after two hours | Compression strength [MPa] after 24 hours |
| Comparative Example 11 | Condensed product 1 | 16.11 | 53.74 | HMF | 30.00 | 0.15 | 2,5-DHB | 30.00 | Methanol | 70.00 | 0.21 | 0 | 0 | 0 |
| Comparative Example 12 | Condensed product 1 | 16.11 | 53.74 | HMF | 30.00 | 0.15 | 2,3-DHB | 30.00 | Methanol | 70.00 | 0.21 | 0 | 0 | 0 |
| Comparative Example 13 | Condensed product 1 | 16.11 | 53.74 | HMF | 30.00 | 0.15 | 3,4-DHB | 30.00 | Methanol | 70.00 | 0.21 | 0 | 0 | 0 |
| Comparative Example 14 | Condensed product 1 | 16.11 | 53.74 | HMF | 30.00 | 0.15 | p-HB | 30.00 | Methanol | 70.00 | 0.21 | 0 | 0 | 0 |
| Comparative Example 15 | Condensed product 1 | 16.11 | 53.74 | HMF | 30.00 | 0.15 | Citric acid | 30.00 | Methanol | 70.00 | 0.21 | 0 | 0 | 0 |

* Condensed product 1: 89% by weight of urea-modified furan resin, and 11% by weight of water
* Condensed product 2: 90% by weight of phenolic resin (ratio by mole of formaldehyde to phenol: 1/1.3) and 10% by weight of water
* Condensed product 3: 96% by weight of furfuryl alcohol condensed product and 4% by weight of water
* FFA: furfuryl alcohol
* Silane coupling agent: N-β-(aminoethyl)-γ-aminopropylmethyldimethoxysilane
* DHB: dihydroxybenzoic acid; HB: hydroxybenzoic acid; HMF: 5-hydroxymethylfurfural; and AMF: 5-acetoxymethylfurfural It is understood from the results in Table 2 that in each of Examples 7 to 20, according to the use of 2,6-dihydroxybenzoic acid as a hardening agent together with 5-hydroxymethylfurfural or 5-acetoxymethylfurfural as a binder composition, the hardening speed and the mold strength are improved even when the respective contents by percentage of the binder composition and the curing agent composition in the sand composition for making foundry molds are reduced. Moreover, in Examples 7 to 20, the amount of sulfur dioxide gas generated at the time of casting into a product is controlled into zero since a sulfur-containing acid such as sulfonic acid or sulfuric acid is not used. By contrast, it is understood that in each of Comparative Examples 9 to 15, mold strength is not expressed even after 24 hours and the hardening speed and the mold strength are each deteriorated since the curing agent other than 2,6-dihydroxybenzoic acid is used, even together with 5-hydroxymethylfurfural as a binder composition.

2. A sand composition for making foundry molds according to claim 1, wherein the content by percentage of a sulfur-containing acid in the curing agent composition is 30% or less by weight.

3. The sand composition for making foundry molds according to claim 1, wherein the acid-hardening resin is one or more selected from the group consisting of furfuryl alcohol, furfuryl alcohol condensed products, phenolic resins, and urea-modified furan resins.

4. A sand composition for making foundry molds, comprising a refractory particulate material, a binder composition for making foundry molds that comprises an acid-hardening resin and a curing agent composition for making foundry molds comprising 2,6-dihydroxybenzoic acid, wherein the content of the compound 2,6-dihydroxybenzoic acid is from 0.1 to 0.8 parts by weight for 1.0 part by weight of the binder composition for making foundry molds.

TABLE 3

| | Binder composition | | | | Curing agent composition | | | | | |
|---|---|---|---|---|---|---|---|---|---|---|
| | Resin | | FFA | Silane coupling agent | Curing agent | | Solvent | | Addition amount [part by weight] of curing agent | Mold strength |
| | Species | Addition proportion [% by weight] | Addition proportion [% by weight] | Addition proportion [% by weight] | Species | Addition proportion [% by weight] | Species | Addition proportion [% by weight] | for 1.0 part by weight of binder composition | Compression strength [MPa] after 24 hours |
| Example 21 | Condensed product 1 | 16.11 | 83.74 | 0.15 | 2,6-DHB | 55.00 | Methanol | 45.00 | 0.39 | 1.90 |
| Example 22 | Condensed product 1 | 16.11 | 83.74 | 0.15 | 2,6-DHB | 50.00 | Methanol | 50.00 | 0.35 | 1.79 |
| Comparative Example 16 | Condensed product 1 | 16.11 | 83.74 | 0.15 | Oxalic acid | 50.00 | Methanol | 50.00 | 0.35 | 1.25 |

* Condensed product 1: 89% by weight of urea-modified furan resin, and 11% by weight of water
* FFA: furfuryl alcohol
* Silane coupling agent: N-β-(aminoethyl)-γ-aminopropylmethyldimethoxysilane
* DHB: dihydroxybenzoic acid According to the results in Table 3, in Examples 21 and 22, and Comparative Example 22, the use amount of each of their binder composition and their curing agent composition was a half of that in each of the cases in Table 1. Specifically, the test examples were made under the condition that the amount of the binder composition was 1.0 part by weight and that of the curing agent composition was 0.7 parts by weight for 100 parts by weight of their silica new sand, so that the mold strength was reduced by half. It is demonstrated that the mold strength of Examples 21 and 22 is at a sufficiently advantageous level, this situation being different from that of Comparative Example 16.

The invention claimed is:

1. A sand composition for making foundry molds, comprising a refractory particulate material, a binder composition for making foundry molds that comprises an acid-hardening resin and a curing agent composition for making foundry molds comprising 2,6-dihydroxybenzoic acid, wherein the binder composition for making foundry molds is contained in an amount of 0.5 to 3.0 parts by weight for 100 parts by weight of the refractory particulate material, and the curing agent composition for making foundry molds is contained in an amount of 0.07 to 2.0 parts by weight for the same.

5. A sand composition for making foundry molds, comprising a refractory particulate material, a binder composition for making foundry molds that comprises an acid-hardening resin and a curing agent composition for making foundry molds comprising 2,6-dihydroxybenzoic acid, wherein the binder composition for making foundry molds further comprises one or more 5-position-substituted furfural compounds selected from the group consisting of 5-hydroxymethylfurfural and 5-acetoxymethylfurfural.

6. The sand composition for making foundry molds according to claim 5, wherein the content by percentage of the 5-position-substituted furfural compound(s) in the binder composition is from 5 to 80% by weight.

7. A sand composition for making foundry molds, comprising a refractory particulate material, a binder composition for making foundry molds that comprises an acid-hardening resin and a curing agent composition for making foundry molds comprising 2,6-dihydroxybenzoic acid, wherein the nitrogen content by percentage in the binder composition is from 0.5 to 4% by weight.

8. A method of making a foundry mold, comprising a mixing step of mixing a refractory particulate material, a binder composition for making foundry molds that comprises an acid-hardening resin, and a curing agent composition for making foundry molds that comprises 2,6-dihydroxybenzoic acid with each other to yield a sand composition for making foundry molds; and a hardening step of hardening this sand composition to make a foundry mold.

9. The method of making a foundry mold according to claim 8, wherein the content by percentage of the compound 2,6-dihydroxybenzoic acid in the curing agent composition is from 10 to 80% by weight.

10. The method of making a foundry mold according to claim 8, wherein the binder composition for making foundry molds is added in an amount of 0.5 to 3 parts by weight for 100 parts by weight of the refractory particulate material, and the curing agent composition for making foundry molds is added in an amount of 0.07 to 2.0 parts by weight for the same.

11. The method of making a foundry mold according to claim 8, wherein the content of the compound 2,6-dihydroxybenzoic acid is from 0.1 to 0.8 parts by weight for 1.0 part by weight of the binder composition for making foundry molds.

12. The method of making a foundry mold according to claim 8, wherein the binder composition for making foundry molds further comprises one or more 5-position-substituted furfural compounds selected from the group consisting of 5-hydroxymethylfurfural and 5-acetoxymethylfurfural.

13. The method of making a foundry mold according to claim 12, wherein the content by percentage of the 5-position-substituted furfural compound(s) in the binder composition is from 5 to 80% by weight.

14. The method of making a foundry mold according to claim 8, wherein the mixing step comprises a first mixing step of mixing the refractory particulate material with the curing agent composition for making foundry molds, which comprises the compound 2,6-dihydroxybenzoic acid, and a second mixing step of mixing the binder composition for making foundry molds with the mixture yielded after the first mixing step.

* * * * *